United States Patent [19]

Wilson

[11] 4,004,919

[45] Jan. 25, 1977

[54] METHOD AND APPARATUS FOR TREATING METAL

[75] Inventor: William G. Wilson, Pittsburgh, Pa.

[73] Assignee: Molycorp, Inc., White Plains, N.Y.

[22] Filed: Aug. 22, 1974

[21] Appl. No.: 499,397

[52] U.S. Cl. ..... 75/53; 75/129; 75/130 BB

[51] Int. Cl.[2] ..... C22C 33/08

[58] Field of Search ..... 75/51, 52, 59, 60, 53, 75/129, 130 BB

[56] References Cited

UNITED STATES PATENTS

| | | | |
|---|---|---|---|
| 2,870,004 | 1/1959 | Estes | 75/51 |
| 2,991,173 | 7/1961 | Trentini | 75/60 |

*Primary Examiner*—P. D. Rosenberg

[57] ABSTRACT

The apparatus disclosed is intended primarily for use in practicing the disclosed method of introducing additives into a molten metal bath contained in a typical ladle or vessel mounted in an upright position with an open mouth at its upper end. The total apparatus includes mechanisms which may be conventional for producing a continuous stream of a fluidized mixture of a carrier gas and solid additive material in particulate form. Various solid additives are introduced into molten pig iron or steel, including aluminum, magnesium, calcium carbide, rare earths, columbium, boron, molybdenum, and many others for such purposes as deoxidizing, desulfurizing, alloying, controlling grain structure, etc. The novel portion of the apparatus includes a discharge tube mounted in upright attitude and extending down into the open mouth of the vessel. The upper inlet end of the tube is flow-connected to the source of the fluidized mixture and the lower discharge end is spaced a selected distance above the bath to eject a free stream of the mixture down toward the bath. The velocity of the stream is so chosen that the energy of the solid particles is sufficient to cause them to penetrate into the bath and the energy of the gas is insufficient to enable it to penetrate into the bath so that it spreads out radially. To prevent the gas from flowing over the whole surface of the bath and causing violent disturbances and splashing, a tubular shield is arranged to surround the stream and extend into the bath. The shield confines the gas to a minor portion of the surface area of the bath and causes the gas to reverse direction and flow out of the open upper end of the shield.

7 Claims, 3 Drawing Figures

METHOD AND APPARATUS FOR TREATING METAL

BACKGROUND OF THE INVENTION

This invention lies in the field of injection systems for introducing various solid additives into a bath of molten metal and is directed particularly to such a system for simply and conveniently injecting solid additives into a bath of molten pig iron or steel while preventing the violent boiling and splashing which occurs with the use of conventional systems. It is simple in construction and reliable in operation.

In general, three systems of introducing additives have been used over a period of years. In one system, chunks of additive material have merely been thrown or shoveled into the bath. One of the major disadvantages of this technique is that there is a little advantage to adding increasingly stronger deoxidizers at progressive intervals during the tapping of the heat because of the high oygen content of the metal in the furnace.

Another system involves reducing the additive material to particulate form, entraining the particles in a stream of air or other gas, and forcing the stream into the bottom of the ladle or vessel through one or more apertures. When the gas is heated by the molten metal, violent boiling results and some of the metal is blown out the mouth of the vessel to endanger workmen in the area. Also, the inlet apertures are frequently plugged by solidifying metal when the bath is poured. In a modification, the stream flows through a pipe, or "lance," which is inserted down into the bath from above. The same boiling and plugging problems arise with this system.

In another variation, a similar pipe is mounted with its discharge end or nozzle spaced some distance above the bath and the stream is ejected down toward the bath with a velocity which drives the particles into the bath but is insufficient to force the gas beneath the surface. In this case the gas spreads out over the surface of the bath and causes violent churning motions which result in much splashing, although it is not as bad as the submerged gas discharges.

SUMMARY OF THE INVENTION

The method and apparatus of the present invention overcome the difficulties and disadvantages mentioned above and provide a simple and reliable system which drives the additive into the bath without also driving in the gas, prevents the gas from causing violent disturbance of the bath surface, and eliminates the plugging problem.

Generally stated, the system involves the use of a conventional source of supply of additive in the form of a continuous stream of gas in which particles of solid additive material are entrained to produce a fluidized mixture. A discharge tube is mounted in upright attitude extending down into the mouth of a conventional ladle or vessel containing a bath of molten metal. The upper inlet end of the tube is connected by a suitable conduit to the source of supply and the lower discharge end serves as a nozzle to eject a free stream of fluidized mixture down toward the surface of the bath, the tube being so mounted that the nozzle is positioned a selected distance above the bath. The stream flows at a selected control velocity, at which velocity the energy of the particles is sufficient to cause them to penetrate into the bath while the energy of the gas is insufficient to enable it to penetrate into the molten metal. Instead, it is diverted at the surface of the bath and flows radially outward.

If the flow were uncontrolled, it would spread over the entire surface of the bath and cause disturbance and splashing. To prevent this result, a tubular shield is provided which is considerably larger in cross section than the discharge tube and is located to surround the stream from the tube and to extend down a substantial distance into the bath. In the presently preferred form, the upper end of the shield is secured to the lower end of the tube and is of such length that its lower end extends into the bath when the lower end of the discharge tube is at the selected distance above the bath.

When the flow is initiated, the gas is diverted radially outward by contact with the bath surface. When it meets the wall of the shield it is diverted upwardly in a column adjacent to the downward flowing stream and exits through one or more openings at the upper end of the shield. The area of contact between the gas and the bath surface is a minor portion of the total surface area of the bath, and the controlled reverse flow substantially eliminates disturbance and splashing.

The relative large cross sectional area of the shield eliminates the plugging problem. Even if there were some buildup resulting from each pour it would take a very long time to decrease the open area enough to call for replacement. Preferably the lower end portion of the shield which is in contact with the molten metal has a refractory surface or is made entirely of refractory material. Thus it will withstand deterioration for an extended period of time. In addition, any slight metal buildup on its surface resulting from one pour will be very largely removed by melting in the next bath in which it is submerged.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figure 1:
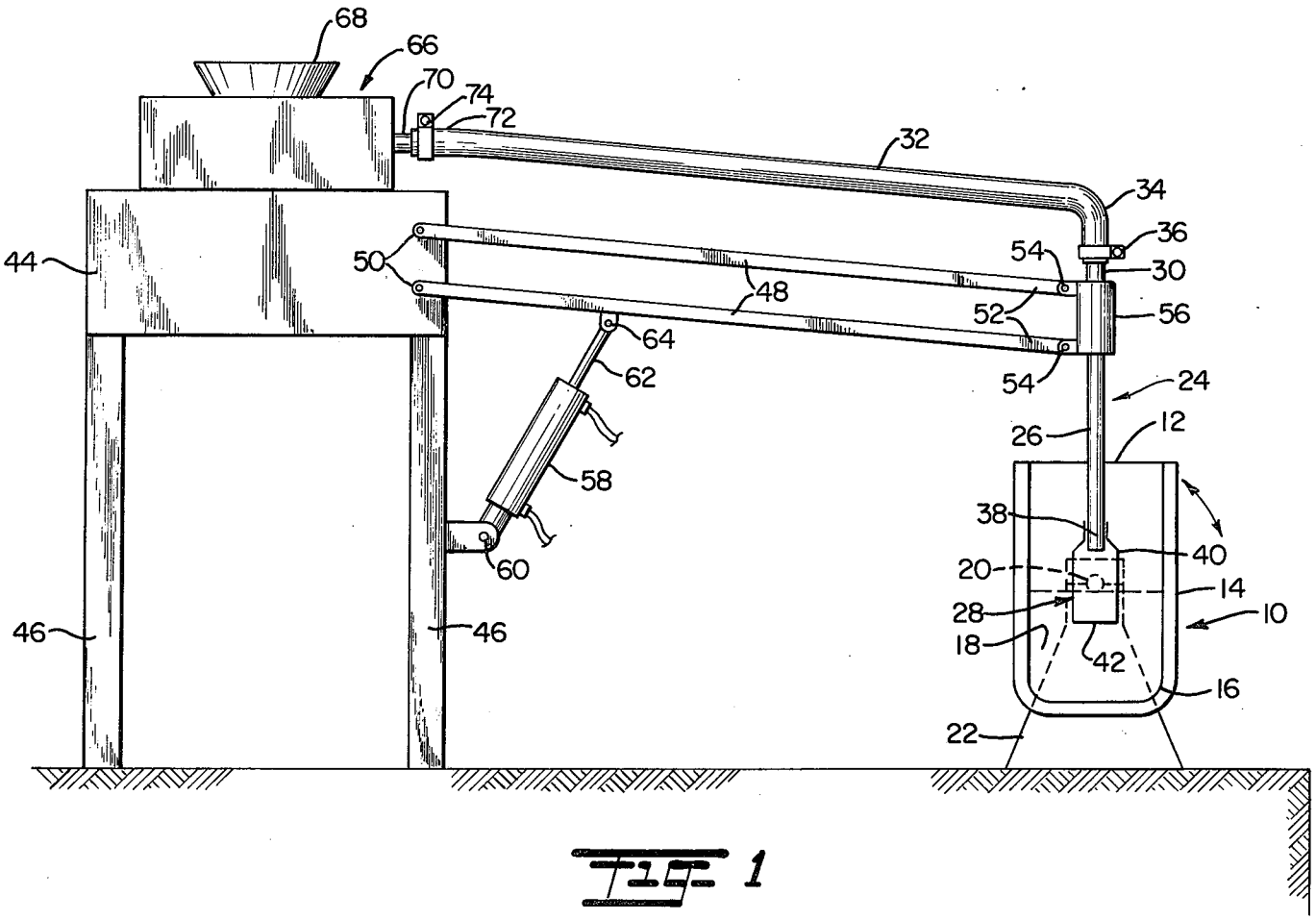
FIG. 1 is a schematic representation in side elevation of the treating system as applied to a conventional pouring ladle containing a bath of molten metal.

An idealized representation of a total system for treating molten metal in which the principles of the invention are utilized is illustrated in FIG. 1. A vessel or container 10, commonly referred to as a ladle, having an open receiving and pouring mouth 12, is shown in an upright attitude ready for the initiation of the treating operation. The vessel has an outer shell 14 of steel and a thick lining 16 of refractory material, and contains a bath 18 of molten metal usually several feet deep. A trunnion pin 20 extending from each side is rotatably carried by a trunnion support 22 at each side to provide for tilting of the vessel in the direction of the arrows to accomplish filling and pouring operations. Servo motor means of any kind such as an electric motor and gear box, not shown, may be mounted on the trunnion support to control the position of the vessel.

The treating mechanism 24 which serves to carry out the principles of the invention includes a discharge tube 26 which is maintained in upright attitude and a tubular shield 28 attached to and extending downward from the tube. The upper inlet end 30 of the tube is preferably cylindrical in configuration for connection to a supply conduit 32, at least the end portion 34 of which is flexible and is secured over the end 30 by a clamp 36. The lower discharge end 38 of the tube serves as a nozzle to eject a free stream of a fluidized mixture of a carrier gas and particles of solid additive material downward toward the bath from a selected distance above the surface.

The upper end 40 of shield 28 is secured to the lower end 38 of the tube and the shield extends downward in a location to circumscribe the axis of the tube. It is of such length that its lower end 42 will extend into the bath when the tube is lowered to the selected level for carrying out the operation.

The discharge tube may be raised, lowered, and held in working position by any of various suitable mechanisms and the one shown in very schematic form is merely exemplary. A platform 44 is supported in elevated position by columns 46 and carries a parallelogram linkage 48 pivoted to the platform at 50. The outer ends 52 of arms 48 are pivotally connected at 54 to a collar 56 secured to the upper portion of the tube. A hydraulic servo motor 58 is pivotally connected at 60 to a column and has a piston rod 62 pivotally connected at 64 to one of the parallelogram arms to raise and lower the linkage.

Any suitable mechanism may be used as a source of supply for a continuous stream of a fluidized mixture of a carrier gas and particles of a solid additive material entrained in the carrier gas, one of which is commonly known as a Basic Refractories Incorporated (BRI) gun. The unit 66 includes a source of a continuous stream of carrier gas and a supply of a solid additive material in particulate form which may be replenished through the inlet 68. A pipe 70 serves as the outlet for the stream of fluidized mixture, and the inlet end 72 of conduit 32 fits over pipe 70 and is secured by clamp 74. Conduit 32 may have flexible end portions and a rigid mid portion or it may be flexible from end to end to allow for the relative movement of the discharge tube.

Figure 2:
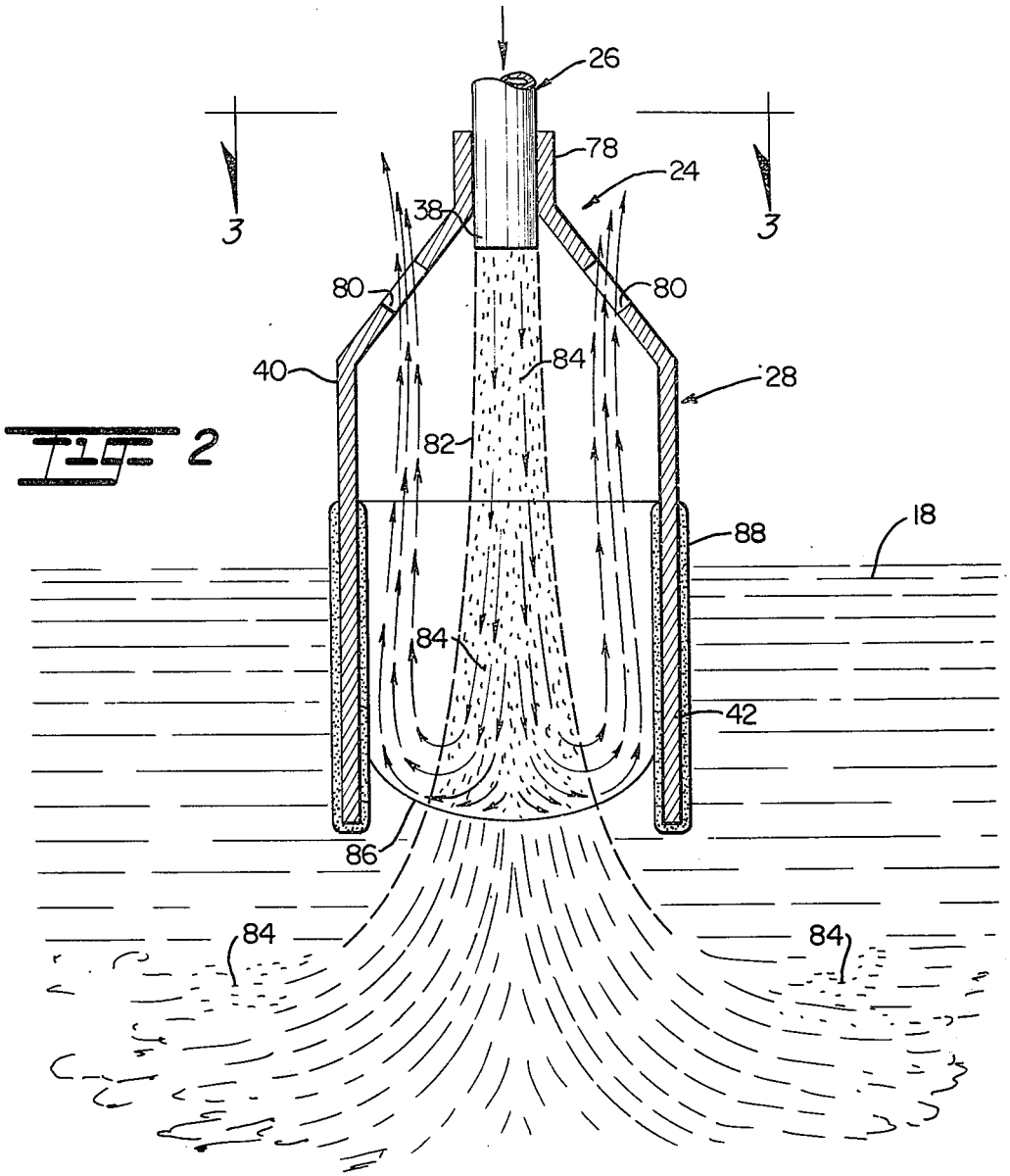
FIG. 2 is a schematic vertical sectional view of the apparatus in treating relation to the bath.
Figure 3:
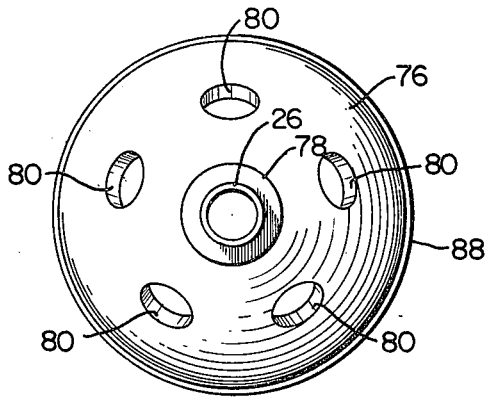
FIG. 3 is a sectional view taken on line 3—3 of FIG. 2.

Although the shield may be arranged laterally in any position in which it will circumscribe the axis of the tube and surround the free stream, it is preferably arranged substantially coaxially of the tube as shown in FIGS. 2 and 3. Although it may be mounted separately, it is preferably secured directly to the tube by suitable means. It may be completely open at the upper end and secured only by stays or straps; it is presently preferred to include a cap 76 shown as conical in form and having an annular flange or band 78 at its upper end fixedly secured to the lower end of the tube by riveting or welding. Either the side wall of the upper end of the shield or the cap, or both, may be provided with one or more apertures 80 for the escape of gas as indicated.

In FIGS. 1 and 2 the discharge end and tube are shown in treating position with the nozzle 38 spaced a selected distance above the static surface level of the bath and with lower end 42 of the shield partially submerged in the bath. The dimensions and the stream velocity vary with the basic conditions and are not limited to specific numbers. However, with a vessel 10 of about twelve feet outside diameter and about ten feet inside diameter, the discharge tube may be about 0.50 to 4 inches in diameter, the shield (if cylindrical) about two to three feet in diameter, the nozzle spaced as high as about six to ten feet above the static surface level of the bath, and the lower end of the shield submerged about a foot or more into the bath. The velocity of the stream at nozzle 38 may be sufficient to drive the material into the bath under the submerged end of the shield.

As seen in FIG. 2, the discharge tube ejects a free stream 82 of fluidized mixture downward toward the surface of the bath. The particles 84 of additive material are much denser than the gas and hence have much greater energy at the same selected velocity, which is so chosen that their energy is sufficient to cause them to penetrate into the bath while the energy of the gas is insufficient to enable it to penetrate into the bath. Consequently, the gas is deflected radially outward at the surface and when it meets the wall of the shield it is deflected upward to flow in a column adjacent to the downward flowing stream and exit at apertures 80.

While the majority of the gas does not penetrate into the bath, its total pressure and the force of flow reversal drive the localized portion of the molten metal confined within the shield downward well below the static surface level of the remainder of the bath and produce a meniscus-like surface 86, through which the particles tend to flow at a normal angle. This feature is of great importance because the particles begin their penetration much closer to the bottom of the bath and begin their interaction at this low level. As they rise in response to the density differential between the particles and the molten metal they have an opportunity to interact with the major portion of total body of molten metal. This reduces or eliminates the need for stirring by the introduction of argon or other inert gas as is done with conventional treating systems.

The shield may be inclined at an angle from the normal as large as 45° or may be normal to the surface. Inclining the shield from normal to the surface would tend to stir the melt providing for better distribution of the added material in the molten bath.

Shield 28 may be made entirely of steel with a coating 88 of suitable refractory material on the lower end portion 42 which is exposed to the molten metal. Alternatively, this portion may be formed of refractory material or the full length of the shell may be made of refractory material. The carrier gas should be inert to the additive material and particularly to the metal of the bath to eliminate reactions which might cause violent disturbance of the surface of the bath in the confined zone of contact.

It will be apparent that the method described above and the apparatus used in its practice provide a superior system for the treatment of molten metal with a minimum amount of equipment and the elimination of the various shortcomings of conventional systems.

What is claimed is:

1. A method of introducing additives of solid material into a molten metal bath, comprising:

providing solid additive material in particulate form;

providing a continuous stream of carrier gas;

entraining the particles of material in the carrier gas stream to produce a fluidized mixture;

directing a free stream of the mixture downward toward the surface of the bath from a selected level above the surface at a selected velocity, at which velocity the energy of the particles is sufficient to enable them to penetrate into the bath and the energy of the gas is insufficient to enable the gas to penetrate into the bath;

utilizing the energy of the particles to separate them from the gas at the surface of the bath and drive them down into the molten metal;

providing an impervious tubular shield around the lower portion of the stream extending below the static surface level of the bath to confine the gas to a contact area substantially less than the total surface area of the bath and to prevent contact of the stream with the remaining portion of the surface of the bath; and utilizing the resistance of the surface of the contact area of the bath to deflect the gas and cause it to flow upward in a column adjacent to the downward flowing stream and within the shield.

2. A method as claimed in claim 1; in which the carrier gas is inert to the additive material.

3. A method as claimed in claim 1; in which the carrier gas is inert to the molten metal in the bath.

4. A method as claimed in claim 1; in which the force of the gas stream is sufficient to depress the surface level of the bath in the area of contact by the gas stream below the static surface level of the remainder of the bath but above the depth of penetration of the shield into the bath.

5. A method as claimed in claim 1; in which the area of the surface of the bath confined within the shield is a minor portion of the total surface area of the bath.

6. A method as claimed in claim 5 in which the area confined within the shield is in the range of about 4 percent to about 10 percent of the total surface area of the bath.

7. A method as claimed in claim 1; in which the free stream flows down substantially centrally of the shield and the reversed upward flow of gas forms a hollow column within the barrier surrounding the free stream.

* * * * *